US005297369A

United States Patent [19]

Dickinson

[11] Patent Number: 5,297,369

[45] Date of Patent: Mar. 29, 1994

[54] BUILDING STRUCTURE WITH IMPROVED SOUNDPROOFING CHARACTERISTICS

[76] Inventor: Sydney L. Dickinson, 306-7660 Minoru Blvd., Richmond, B.C., Canada, V6Y 1Z5

[21] Appl. No.: 57,318

[22] Filed: May 5, 1993

[51] Int. Cl.[5] ..... E04B 1/74

[52] U.S. Cl. ..... 52/281; 52/806; 52/145; 52/481.1; 52/404.3

[58] Field of Search ..... 52/404, 407, 281, 282.1, 52/282.2, 481, 805, 806, 807, 809, 268, 145, 795

[56] References Cited

U.S. PATENT DOCUMENTS

| | | | |
|---|---|---|---|
| 249,645 | 11/1881 | Lowe . | |
| 405,794 | 6/1889 | O'Donnell | 52/481 |
| 1,096,773 | 5/1914 | Vernon . | |
| 1,651,539 | 12/1927 | Olson . | |
| 1,954,582 | 4/1934 | Aschenbrener . | |
| 2,132,032 | 10/1938 | Jacobson | 52/481 |
| 2,177,393 | 10/1939 | Parkinson | 52/145 |
| 2,444,133 | 6/1948 | Groat | 52/481 |
| 2,885,743 | 5/1959 | Macormack | 52/481 |
| 3,295,273 | 1/1967 | Wehe, Jr. | 52/145 |
| 4,037,751 | 7/1977 | Miller et al. | 52/404 |
| 4,471,591 | 9/1984 | Jamison | 52/404 |
| 4,486,997 | 12/1984 | Roy | 52/404 |
| 4,635,417 | 1/1987 | Larouche | 52/145 |
| 5,067,296 | 11/1991 | Brown et al. . | |

FOREIGN PATENT DOCUMENTS

| | | | |
|---|---|---|---|
| 0036888 | 8/1913 | Switzerland | 52/481 |
| 0088914 | 7/1921 | Switzerland | 52/481 |

OTHER PUBLICATIONS

Office of Noise Control, California Department of Health Services; "Catalogue of STC and IIC Ratings for Wall and Floor"; misc. pages.

Acoustical Designing in Architecture; Knudsen et al; pp. 429–433.

*Primary Examiner*—Carl D. Friedman

*Assistant Examiner*—Winnie Yip

*Attorney, Agent, or Firm*—Christie, Parker & Hale

[57] ABSTRACT

A building structure comprising a base and a plurality of spaced support members extending from the base in offset relation. Each support member has an outer edge, side edges and an inner edge and is positioned such that the inner edges of offset support members overlap through a vertical plane in the structure. First and second panels are attached to the outer edges of the support members, the inner edge of each support member being spaced apart from the opposite panel. A plurality of rigid panel members extend between the side edges of any two adjacent support members attached to the same panel and across the inner edge of the intervening offset support member attached to the opposite panel to define a series of three non-communicating chambers between the first and second panels repeated along the length of the structure. The arrangement acts to lessen the transmission of sound through the structure.

7 Claims, 2 Drawing Sheets

BUILDING STRUCTURE WITH IMPROVED SOUNDPROOFING CHARACTERISTICS

FIELD OF THE INVENTION

This invention relates to building structures, and, in particular, relates to a wall partition structure with sound proofing characteristics. Fire proofing is also improved.

BACKGROUND OF THE INVENTION

In North America, building construction techniques tend to rely on a stud frame interior with covering wall panelling. This arrangement tends to transmit sound through the walls unless special soundproofing material is provided. Modern modular wall panel units that are relatively inexpensive to construct and that can be easily handled and assembled are generally of relatively light construction with the result that sound is also easily transmitted through assembled walls. Understandably, neither of these alternatives is desirable in buildings used for apartments and the like if privacy is to be maintained.

In the past, attempts have been made to address the problem of heat and/or sound transmission through walls. U.S. Pat. Nos. 1,651,539 and 1,954,582 disclose stud and panel building constructions that incorporate internal insulation members to limit heat and sound through hollow wall interiors. Both these patents rely on internal studs that extend across the width of the wall to provide a path for transmission of vibration and sound.

U.S. Pat. No. 5,067,296 discloses a modular insulated wall panel having staggered studs and a foam insulation block. While the foam insulation is good for preventing heat loss, its solid nature permits transmission of vibrations and sound.

U.S. Pat. No. 249,645 shows a building construction that uses staggered studs, inter-stud partitions and sawdust insulation to create a insulated, sound proof wall or floor construction. U.S. Pat. No. 1,096,773 discloses a building construction arrangement that uses staggered studs and an undulating internal lining extending across the ends of the linings to create a sound and thermal barrier. The interior wall cavity is divided into a plurality of dual chambers. The use of staggered studs avoids the problem of vibration and sound transmission through the walls by way of the studs, however, when cavities are cut in both outside walls to accommodate electrical outlets and the like, the sound proofing ability of the internal dual chambers is compromised. Current building codes often require that electrical and other outlets be caulked or sealed to control such sound transmission.

SUMMARY OF THE INVENTION

The present invention provides a building structure that addresses the problem of sound transmission through studs and outlet cavities by using a novel internal arrangement of studs and rigid partitions extending between groups of studs. Accordingly, the present invention provides a building structure comprising:

a base;

a plurality of spaced support members extending from the base in offset relation, each support member having an outer edge, side edges and an inner edge and positioned such that the inner edges of offset support members overlap through a vertical plane in the structure;

first and second panels attached to the outer edges of the support members, the inner edge of each support member being spaced apart from the opposite panel; and a plurality of rigid panel members extending between the side edges of any two adjacent support members attached to the same panel and across the inner edge of the intervening offset support member attached to the opposite panel to define a series of three non-communicating chambers between the first and second panels repeated along the length of the structure to lessen the transmission of sound through the structure.

BRIEF DESCRIPTION OF THE DRAWINGS

Aspects of the present invention are illustrated, merely by way of example, in the accompanying drawings in which.

DESCRIPTION OF THE PREFERRED EMBODIMENT

Figure 1:
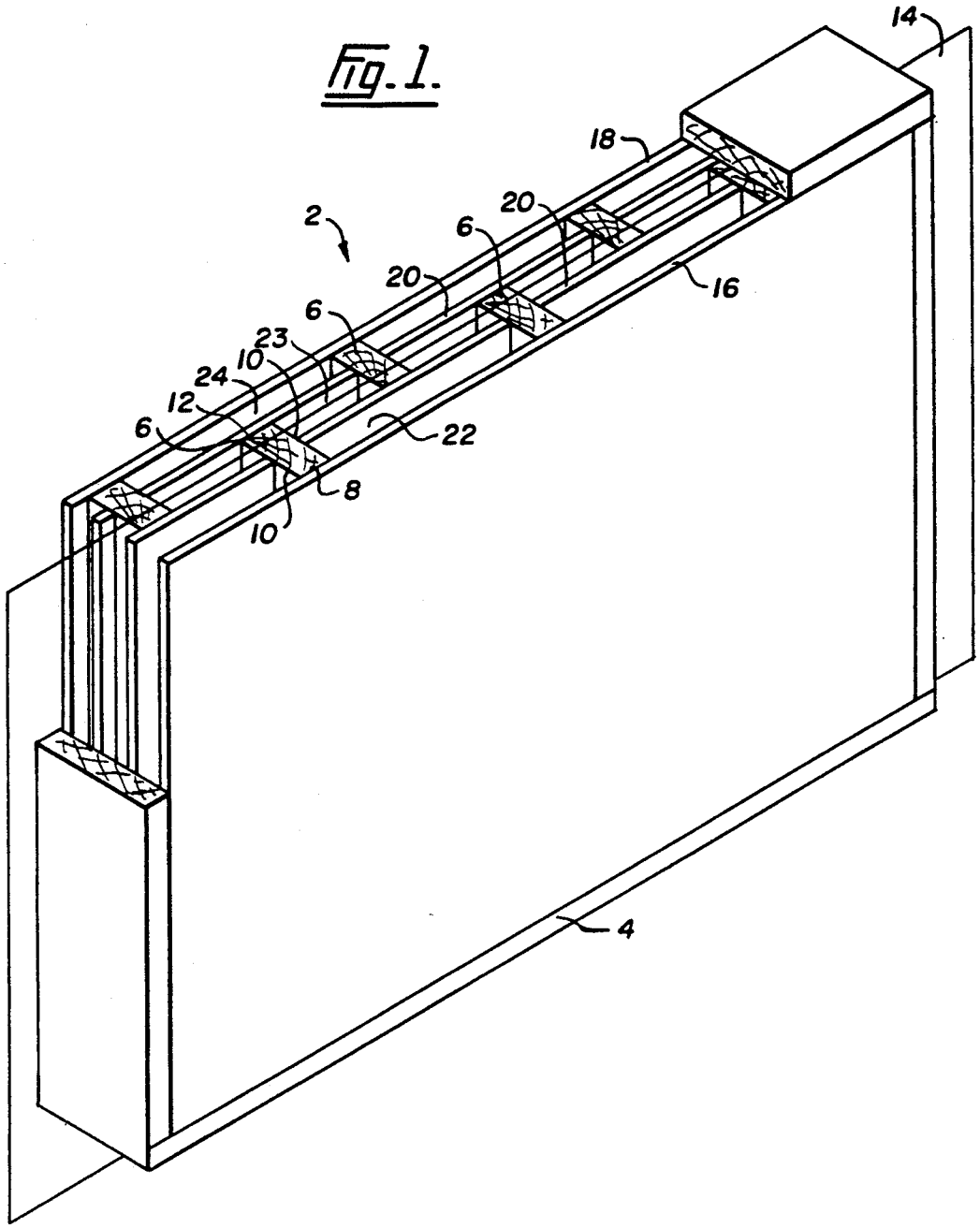
FIG. 1 is a perspective view of a preferred embodiment of a building structure according to the present invention.
Figure 2:
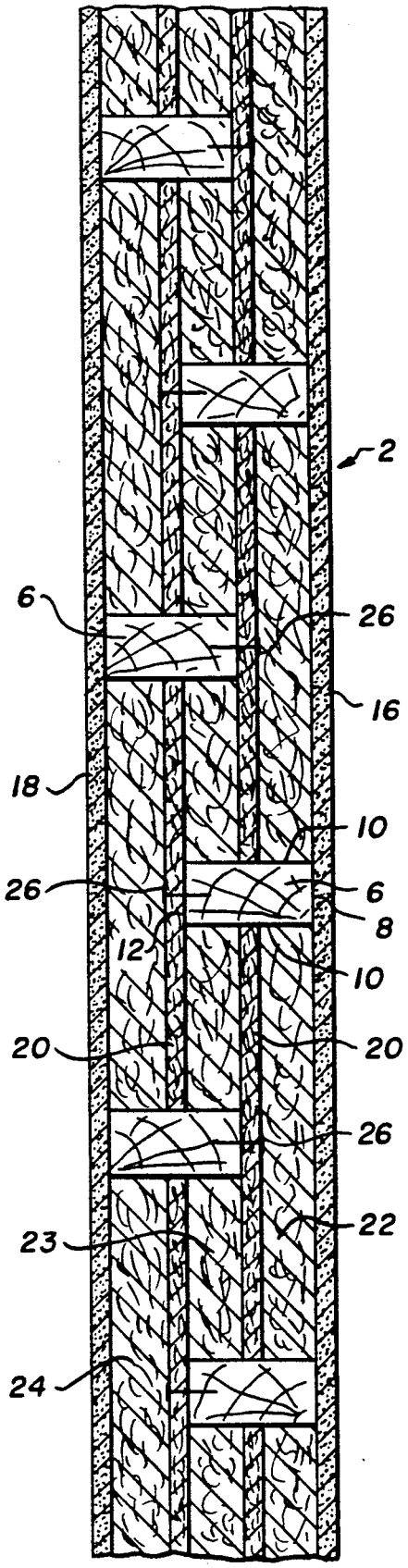
FIG. 2 is a plan view of the building structure of FIG. 1.

FIGS. 1 and 2 show a preferred embodiment of a building structure 2 according to the present invention for use as a wall partition. It will be understood that the structure of the present invention can also be used in floor or ceiling construction.

In use as a wall partition, structure 2 includes a base 4 that supports a plurality of spaced support members 6 extending from the base in offset relation. Each support member 6 has an outer edge 8, side edges 10 and an inner edge 12. Support members 6 are positioned such that the inner edges 12 of offset support members overlap through a vertical plane 14 in the structure. In a typical arrangement, support members 6 are conventional 2×4 wooden studs and base 4 is a 2×6 wooden plate. Alternatively, base 4 can be formed from two separated 2×4 plates. A split 2×6 plate can be used, that is, with a gap in a 2×6 plate formed, for example, by a saw cut.

First and second panels 16 and 18, respectively, are attached to the outer edges 8 of the support members and the inner edge of each support member is spaced apart from the opposite panel. Panels 16 and 18 are typically gypsum board panels and enclose the interior of the building structure which is divided into a plurality of overlapping chambers.

A plurality of rigid panel members 20 extend between the side edges 10 of any two adjacent support members 6 attached to the same panel and across the inner edge 12 of the intervening offset support member attached to the opposite panel. Rigid panel members 20 are formed from sound insulating material, preferably, mineral wool rigid board or equivalent. Panel members 20 are attached to the support members primarily by attachment means in the form of nails 26 that are driven through panel members 20 into the inner edges 12 of each support member. The end edges of panel members 20 abutting inside edges 10 of the support members are press fitted into place. Nails 26 may be roofing nails or nails used with washers.

As best shown in FIG. 2, panel members 20 define a series of three non-communicating chambers 22, 23 and 24 between the first and second panels repeated along the length of the structure. The chambers define air spaces that lessen the transmission of sound through the structure by absorbing vibrations.

Chambers 22, 23 and 24 can be filled with sound insulating material to further reduce sound transmission through the structure.

The offset supporting member and triple chamber construction of the present invention means that even if cavities are cut in panels 16 and 18 directly opposite from each other to accommodate an electrical outlet, vent or the like, there is always a central chamber 23 and at least two rigid panel members 20 to absorb sound thereby making caulking or sealing of the cavity unnecessary.

The wall partition building structure illustrated in the Figures will generally include a peripheral frame about the structure defining top, bottom and end edges for connecting to adjacent partitions and floors and ceilings.

Although the present invention has been described in some detail by way of example for purposes of clarity and understanding, it will be apparent that certain changes and modifications may be practised within the scope of the appended claims.

I claim:

1. A building structure comprising:

a base;

a plurality of spaced support members extending from the base in offset relation, each support member having an outer edge, side edges and an inner edge and positioned such that the inner edges of offset support members overlap through a vertical plane in the structure;

first and second panels attached to the outer edges of the support members, the inner edge of each support member being spaced apart from the opposite panel; and a plurality of rigid panel members extending between the side edges of any two adjacent support members attached to the same panel and across the inner edge of the intervening offset support member attached to the opposite panel to define a series of three non-communicating chambers between the first and second panels repeated along the length of the structure to lessen the transmission of sound through the structure.

2. A building structure as claimed in claim 1 in which each of the rigid panel members comprises a panel of sound insulating material.

3. A building structure as claimed in claim 2 in which the sound insulating material is mineral wool rigid board.

4. A building structure as claimed in claim 2 in which the chambers are filled with sound insulating material.

5. A building structure as claimed in claim 1 in which the base is incorporated into a peripheral frame for the structure defining top, bottom and end edges.

6. A building structure as claimed in claim 1 in which the rigid panels are attached to the support members primarily by attachment means located on the inner edge of each support member.

7. A building structure as claimed in claim 6 in which the attaching means comprises nails.

* * * * *